United States Patent [19]

Blackman et al.

[11] Patent Number: 4,775,873

[45] Date of Patent: Oct. 4, 1988

[54] PHOTOGRAPHIC FILM PROCESSOR RACK AND TANK ASSEMBLY

[75] Inventors: Robert J. Blackman; Peter G. Stromberg, both of Rochester, N.Y.

[73] Assignee: Eastman Kodak Company, Rochester, N.Y.

[21] Appl. No.: 153,112

[22] Filed: Feb. 5, 1988

[51] Int. Cl.[4] ..... G03D 3/02; G03D 3/13

[52] U.S. Cl. ..... 354/321; 354/324

[58] Field of Search ..... 354/320, 321, 322, 324, 354/325, 328; 134/64 P, 122 P

[56] References Cited

U.S. PATENT DOCUMENTS

| | | | |
|---|---|---|---|
| 1,177,697 | 4/1916 | Gaumont . | |
| 1,967,889 | 8/1930 | Kitroser . | |
| 2,475,658 | 8/1944 | Briechle . | |
| 2,853,294 | 12/1957 | Woodcock . | |
| 3,192,845 | 7/1965 | Schmidt | 354/321 |
| 3,311,039 | 3/1967 | Lucas | 354/324 |
| 3,388,653 | 7/1967 | Mayfield . | |
| 3,463,073 | 8/1969 | Knibiehly . | |
| 3,595,159 | 7/1971 | Bull | 134/122 P |
| 3,831,612 | 8/1974 | Limoges | 134/122 |
| 3,860,944 | 1/1975 | Huber et al. | 354/324 |
| 3,922,702 | 11/1975 | Gaskell | 354/321 |
| 4,295,728 | 10/1981 | Nishimoto | 354/321 |
| 4,312,585 | 1/1982 | Otsu et al. | 354/321 |
| 4,332,454 | 6/1982 | Hensel et al. | 354/317 |
| 4,512,645 | 4/1985 | Engelhardt | 354/324 |
| 4,613,221 | 9/1986 | Takase et al. | 354/321 |
| 4,666,279 | 5/1987 | Fujita | 354/320 |
| 4,687,313 | 8/1987 | Taniguchi et al. | 354/320 |
| 4,736,222 | 4/1988 | Stromberg | 354/324 |

*Primary Examiner*—A. A. Mathews

*Attorney, Agent, or Firm*—Roger A. Fields

[57] ABSTRACT

An improved photographic film processing apparatus is generally of the type wherein an upright processing rack is located within a processing tank adapted to contain a processing liquid for treating the emulsion side of a filmstrip, wherein a timing belt is moved through a vertical guide slot for advancement along the rack to draw successive sections of the filmstrip through a vertical processing channel within the tank, and wherein a plurality of liquid distribution openings to the processing channel direct the processing liquid against the emulsion side of a film section in the processing channel. According to the invention, the tank has respective integral portions shaped to define a first vertical side of the guide slot for the timing belt and to define a first vertical side of the processing channel for the filmstrip. The rack has respective integral portions shaped to define a second vertical side of the guide slot, opposite the first vertical side of the guide slot, and to define a second vertical side of the processing channel, opposite the first vertical side of the processing channel. The integral portion of the rack which defines the second vertical side of the processing channel includes the plurality of liquid distribution openings to the processing channel. This arrangement provides a relatively simple, compact assembly.

5 Claims, 4 Drawing Sheets

PHOTOGRAPHIC FILM PROCESSOR RACK AND TANK ASSEMBLY

CROSS-REFERENCE TO RELATED APPLICATIONS

Reference is made to commonly assigned, copending patent applications Ser. No. 064,420 entitled Apparatus for Photographic Film Processing, and filed June 22, 1987 in the names of Robert J. Blackman and Robert A. Burkovich and Ser. No. 064,421 entitled Liquid Distribution Box and filed June 22, 1987 in the name of Peter G. Stromberg, now U.S. Pat. No. 4,736,222.

BACKGROUND OF THE INVENTION

1. Field of the Invention

The invention relates generally to a photographic film processing apparatus. More particularly, the invention relates to an apparatus for treating exposed film in one or more processing liquids in a manner which assures the positive application of each processing liquid to the emulsion side of the film as the film is transported through the processing liquid.

2. Description of the Prior Art

The processing of photographic film involves a series of steps such as developing, bleaching, fixing, rinsing, and drying. These steps lend themselves to mechanization by conveying long strips of film sequentially through a series of stations or tanks, each one containing a different processing liquid appropriate to the process step at that station.

Typically, the filmstrip being processed is immersed in and drawn through a developing liquid or other processing liquid. The thoroughness and therefore the quality of processing depends on, among other things, a thorough interaction of the film emulsion and the processing liquid. For effective and quality processing, some movement of the processing liquid, i.e. "agitation", is required to assure that fresh liquid is continually brought into contact with the film emulsion.

The Cross-Referenced Applications

In the first patent application (Ser. No. 064,420) cross-referenced above, there is disclosed a photographic film processor which includes an upright processing rack immersed in a processing liquid tank. The upright rack has two oppositely spaced pairs of mating vertical rack panels, each pair defining a vertical guide slot for an endless timing belt and at least one vertical film processing channel. The endless timing belt extends over a drive sprocket at the top of the processing rack, over an idler sprocket at the bottom of the rack, and along the two vertical guide slots defined by the respective opposite pairs of vertical rack panes. The timing belt has inner teeth for engagement with the sprockets and outer teeth for engagement with a flexible film leader card to which at least one exposed filmstrip is secured. Rotation of the drive sprocket advances the timing belt continuously down one vertical guide slot and up the other in order to pull the exposed filmstrip down a vertical film processing channel in one pair of rack panels and up a vertical processing channel in the opposite pair of rack panels. A processing liquid is pumped into a central vertical cavity between the two opposite pairs of vertical rack panels and is constrained for positive flow through numerous rectangular inlet openings in each inner rack panel at either side of the central cavity. The processing liquid is directed against the emulsion side of successive sections of the filmstrip being pulled along the vertical processing channels, and out of corresponding outlet openings in each outer rack panel proximate the walls of the processing tank. Then, the used liquid flows downwardly between each outer rack panel and the tank walls to drain through an outlet port at the tank bottom.

In the second patent application (Ser. No. 064,421, now U.S. Pat. No. 4,736,222) cross-referenced above, a liquid distribution box is disposed in the central vertical cavity between the two opposite pairs of vertical rack panels to receive the processing liquid which would otherwise be pumped into that cavity. The distribution box includes respective series of staggered relatively small orifices positioned to discharge the processing liquid in a jet-like manner from the interior of the box, through the rectangular inlet openings in each inner rack panel, and against the emulsion side of successive sections of the filmstrip being pulled along the vertical processing channels. The small orifices effect an improved agitation of the processing liquid adjacent the emulsion side of the film sections in the processing channels.

SUMMARY OF THE INVENTION

An improved photographic film processing apparatus is provided which is generally of the type wherein an upright processing rack is located within a processing tank adapted to contain a processing liquid for treating the emulsion side of a filmstrip, wherein a timing belt is moved through a vertical guide slot for advancement along the rack to draw successive sections of the filmstrip through a vertical processing channel within the tank, and wherein a plurality of liquid distribution openings to the processing channel direct the processing liquid against the emulsion side of a film section in the processing channel.

According to the invention, the tank has respective integral portions shaped to define a first vertical side of the guide slot for the timing belt and to define a first vertical side of the processing channel for the filmstrip. The rack has respective integral portions shaped to define a second vertical side of the guide slot, opposite the first vertical side of the guide slot, and to define a second vertical side of the processing channel, opposite the first vertical side of the processing channel. The integral portion of the rack which defines the second vertical side of the processing channel includes the plurality of liquid distribution openings to the processing channel. This arrangement provides a relatively simple, compact assembly as compared to known prior art devices and the processing apparatus disclosed in the two patent applications cross-referenced above. For example, in the first cross-referenced application, the rack itself defines both vertical sides of the processing channel and both vertical sides of the guide slot. The tank serves no purpose in this connection. In the second cross-referenced application, the liquid distribution box includes the plurality of liquid distribution openings and is separate from the rack.

DETAILED DESCRIPTION OF THE PREFERRED EMBODIMENT

Figure 1:
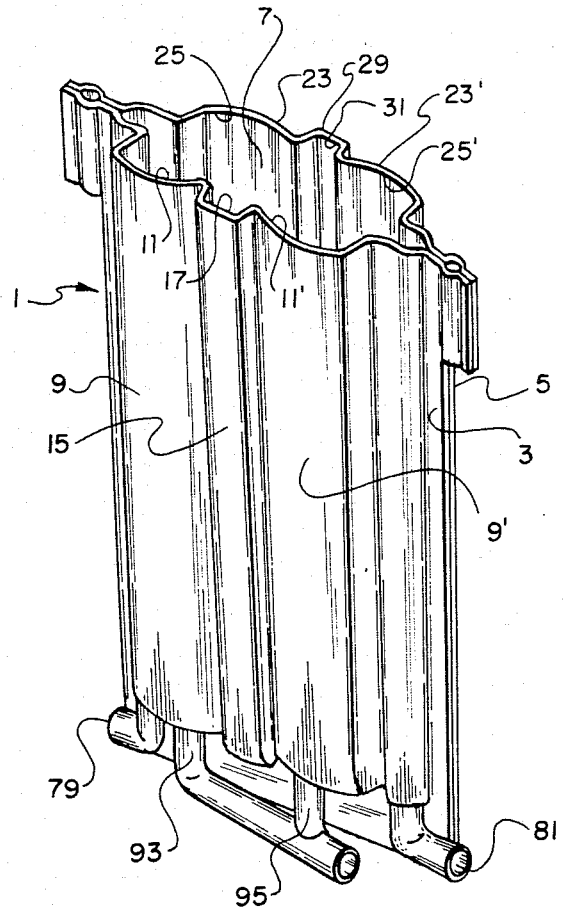
FIG. 1 is a top front perspective view of a film processing tank according to a preferred embodiment of the invention.
Figure 5:
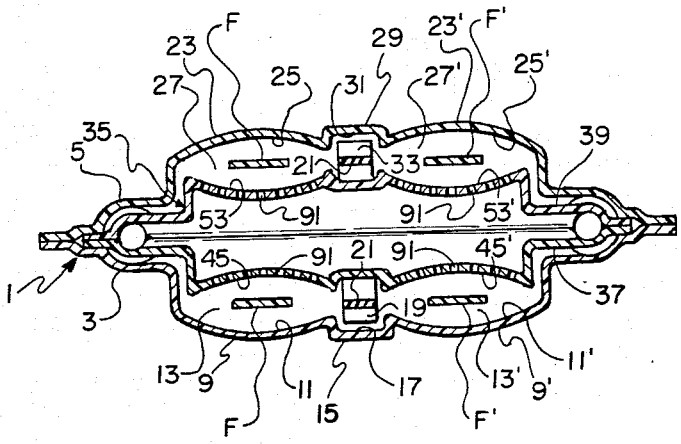
FIG. 5 is a cross-sectional view of the combined rack and tank as seen in the direction of the arrows from the line 5—5 in FIG. 4.

Referring now to the drawings, and in particular to FIGS. 1 and 5, there is illustrated a film processing tank 1 having front and back parallel wall members 3 and 5 which between the two members form an open top tank cavity 7. The front and back wall members 3 and 5 may be separate mating pieces, or they may be simply the opposite sides of a unitary structure. As most clearly shown in FIG. 5, the front wall member 3 has respective similar integral portions 9 and 9' shaped to define first (outer) vertical sides 11 and 11' of two similar, parallel, front vertical film processing channels 13 and 13' for receiving successive sections of separate exposed filmstrips F and F'. Also, the front wall member 3 has an integral portion 15, located midway between the two integral portions 9 and 9', shaped to define a first (outer) vertical side 17 of a front vertical guide slot 19 for an endless timing belt 21. The back wall member 5 is identical to the front wall member 3 as to its arrangement. That is, it has respective similar integral portions 23 and 23' shaped to define first (outer) vertical sides 25 and 25' of two similar, parallel, rear vertical film processing channels 27 and 27' for receiving successive sections of the filmstrips F and F'. Also, the back wall member 5 has an integral portion 29, located midway between the two integral portions 23 and 23', shaped to define a first (outer) vertical side 31 of a rear vertical guide slot 33 for the endless timing belt 21.

Figure 2:
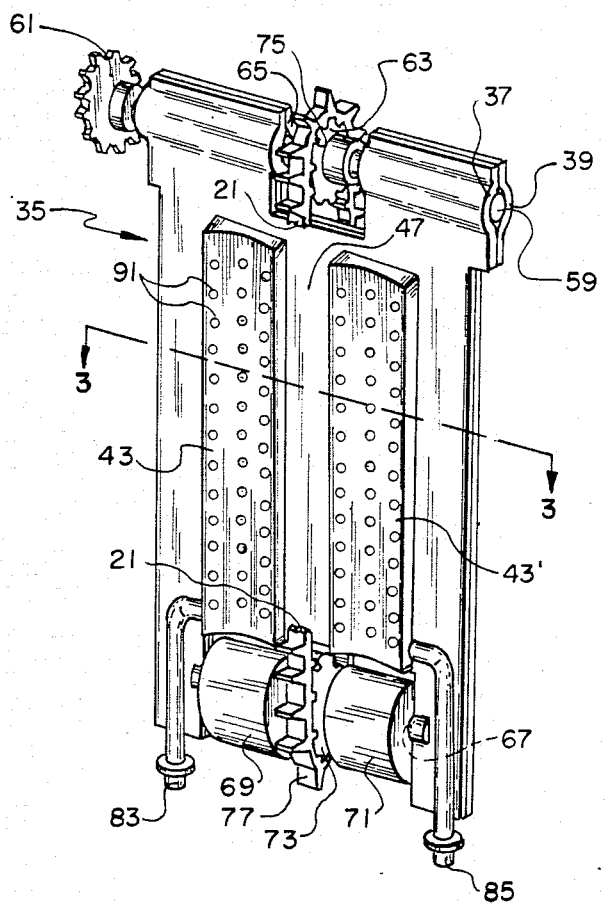
FIG. 2 is a top front perspective view of a film processing rack according to the preferred embodiment of the invention.
Figure 3:
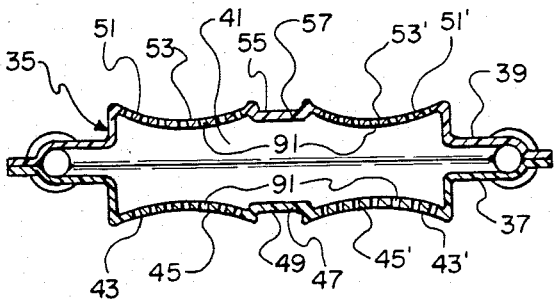
FIG. 3 is a cross-sectional view of the processing rack as seen in the direction of the arrows from the line 3—3 in FIG. 2.
Figure 4:
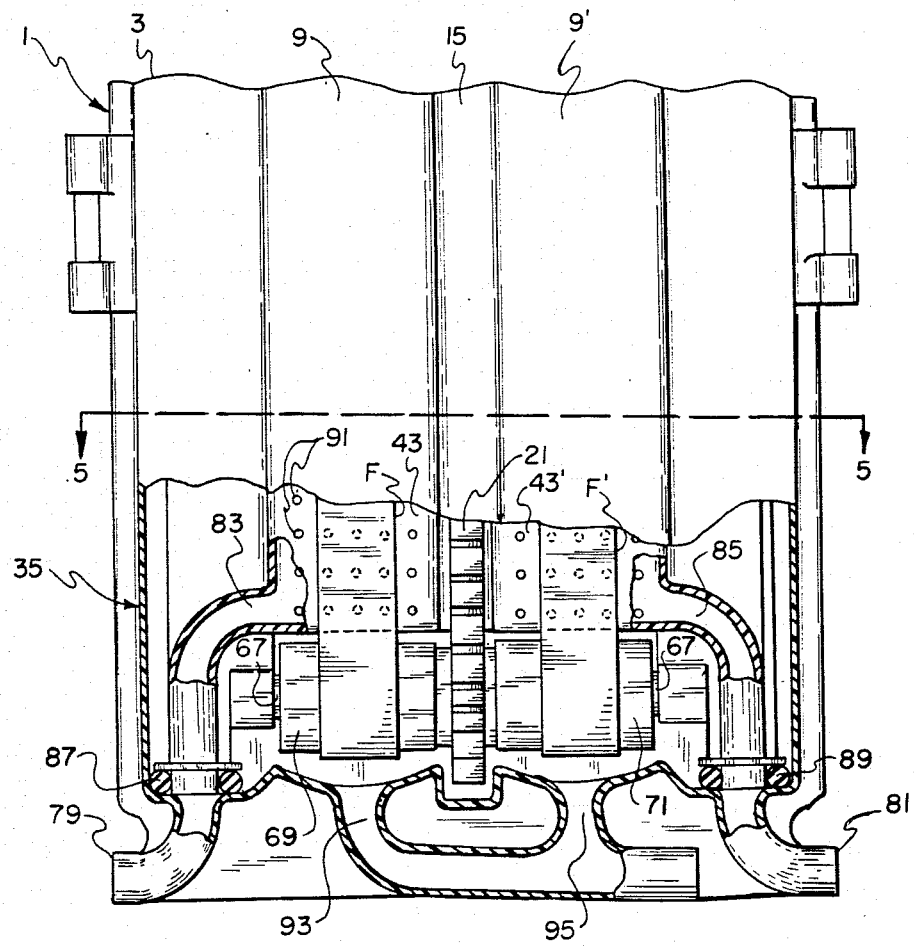
FIG. 4 is a front elevational view of the processing tank and the processing rack, showing the rack located within the tank to form a combined assembly.

In FIGS. 2 and 3, there is illustrated a processing rack 35 which (as shown in FIGS. 4 and 5) is intended to be situated upright in the open-top cavity 13 of the processing tank 1. As in the case of the tank 1, the rack 35 has front and back parallel wall members 37 and 39 which between the two members form a functional cavity 41. The front and back wall members 37 and 39 may be separate mating pieces, or they may be simply the opposite sides of a unitary structure. In either instance, the two wall members 37 and 39 substantially enclose the cavity 41. As most clearly shown in FIGS. 3 and 5, the front wall member 37 has respective similar integral portions 43 and 43' shaped to define second (inner) vertical sides 45 and 45' of the two front processing channels 13 and 13' for the filmstrips F and F'. Also, the front wall member 37 has an integral portion 47, located midway between the two integral portions 43 and 43', shaped to define a second (inner) vertical side 49 of the front guide slot 19 for the endless timing belt 21. The back wall member 39 is identical to the front wall member 37 as to its arrangement. That is, it has respective similar integral portions 51 and 51' shaped to define second (inner) vertical sides 53 and 53' of the two rear processing channels 27 and 27' for the filmstrips F and F'. Also, the back wall member 39 has an integral portion 55, located midway between the two integral portions 51 and 51', shaped to define a second (inner) vertical side 57 of the rear guide slot 33 for the timing belt 21.

When the processing rack 35 is supported by suitable means, not shown, upright in the open-top cavity 13 of the processing tank 1, as shown in FIGS. 4 and 5, the front and rear processing channels 13, 13' and 27, 27' for the filmstrips F and F' are thereby formed, and the front and rear guide slots 19 and 33 for the endless timing belt 21 are thereby formed. The front and rear processing channels 13, 13' and 27, 27' are open at their respective tops and bottoms to permit successive sections of the filmstrips F and F' to enter the front processing channels at their tops, move down the front processing channels, cross over from the front processing channels to the rear processing channels at their bottoms, move up the rear processing channels, and exit the rear processing channels at their tops. Similarly, the front and rear guide slots 19 and 33 for the timing belt 21 are open at their respective tops and bottoms to permit the timing belt to continuously move down the front guide slot and up the rear guide slot.

As shown in FIG. 2, a drive shaft 59 is rotatably mounted proximate the top of the processing rack 35 between its front and back wall members 37 and 39. A drive gear, pulley, or sprocket 51 is coaxially fixed to one end of the drive shaft 39. A timing pulley or sprocket 63 is coaxially fixed to the drive shaft 59, intermediate its ends, within a clearance opening 65 cut in the front and back wall members 37 and 39. Similarly, an idler shaft 67 is rotatably mounted proximate the bottom of the processing rack 35 between the front and back wall members 37 and 39. The idler shaft 67 is located parallel to the drive shaft 59 and includes respective identical coaxial idler rollers 69 and 71 which are disposed to guide successive sections of the filmstrips F and F' from the front processing channels 13, 13' to the rear processing channels 27, 27', at the bottom of each channel. An idler pulley or sprocket 73 is coaxially fixed to the idler shaft 67 in vertical alignment with the timing sprocket 63 on the drive shaft 59. Both the timing sprocket 63 and the idler sprocket 73 are disposed to advance the endless timing belt 21 continuously down the front guide slot 19 and up the rear guide slot 33. As is known in the art, and disclosed in the patent applications cross-referenced above, the timing and idler sprockets 63, 73 synchronously engage inner teeth 75 of the timing belt 21 to advance the belt. Also, a flexible leader card to which respective leading ends of the filmstrips F and F' are secured, not shown, has a series of apertures for engaging outer teeth 77 of the timing belt 21. Thus, rotation of the drive gear 61 will advance the timing belt 21 continuously down the front guide slot 19 and up the rear guide slot 33 to cause a leader card in engagement with the belt to pull successive sections of the filmstrips F and F' down the front processing channels 13, 13' and up the rear processing channels 27, 27'.

During movement of successive sections of the filmstrips F and F' down the front processing channels 13, 13' and up the rear processing channels 27, 27', a processing liquid is pumped into liquid introduction pipes 79 and 81 integral with the processing tank. See FIGS. 1, 2 and 4. Since the processing rack 35 includes integral liquid introduction conduits 83 and 85 which mate in a liquid-sealing relation, provided by suitable O-rings 87 and 89, with the respective pipes 79 and 81, the processing liquid is forced into the enclosed cavity 41 of the rack 35. As most clearly shown in FIGS. 2 and 5, the rack 35 at the integral portions 43, 43' and 51, 51' of its front and back wall members 37 and 39 has respective arrays of liquid distribution openings 91 to the front and rear processing channels 13, 13' and 27, 27'. These openings 91 are relatively small and are arranged in numerous series of alternating numbers of openings, e.g. 1-2-1-2-1 . . . As a result, the openings 91 serve to discharge the processing liquid in a jet-like fashion from the enclosed cavity 41 into the front and rear processing channels 13, 13' and 27, 27', and against the emulsion side of successive sections of the filmstrips F and F' being pulled along the processing channels. In addition, the openings 91 effect an improved agitation of the processing liquid adjacent the emulsion side of the film sections.

As shown in FIGS. 1 and 4, the processing tank 1 includes integral drain conduits 93 and 95 leading from between the front and rear processing channels 13, 13' and 27, 27'. Alternatively a single drain conduit may be located beneath the idler sprocket 73. After the processing liquid is directed against the emulsion side of successive sections of the filmstrips F and F' being pulled along the processing channels, it flows around the longitudinal edges of the film sections and down the respective channels to the drain conduits 93 and 95. Then, the processing liquid flows out of the drain conduits to a depository.

Operation

In operation, the flexible leader card to which the leading ends of the filmstrips F and F' are secured, is advanced by the endless timing belt 21 downwardly and upwardly along a U-shaped path commensurate with movement of the belt. Then, as is known in the art, the leader card is disengaged from the timing belt 21 and transferred to another belt associated with a different rack, not shown. Concurrently, the filmstrips F and F' are pulled downwardly and upwardly along similar U-shaped paths, during which time they are treated by the processing liquid. Then, the filmstrips F and F' are pulled from the processing tank 1 to another one, not shown, for a different liquid treatment.

The invention has been described in connection to a preferred embodiment. However, it will be appreciated that variations and modifications can be effected within the ordinary skill in the art without departing from the scope of the invention. For example, instead of providing four processing channels and two guide slots, any number of channels and slots may be devised.

We claim:

1. An improved photographic film processing apparatus of the type wherein (a) an upright processing rack is located within a processing tank adapted to contain a processing liquid for treating the emulsion side of a filmstrip, (b) a timing belt is moved through a vertical guide slot for advancement along said rack to draw successive sections of the filmstrip through a vertical processing channel within said tank, and (c) a plurality of liquid distribution openings to said processing channel direct the processing liquid against the emulsion side of a film section in the processing channel, and wherein the improvement comprises:

said tank has respective integral portions shaped to define a first vertical side of said guide slot for said timing belt and to define a first vertical side of said processing channel for the filmstrip; and said rack has respective integral portions shaped to define a second vertical side of said guide slot, opposite said first vertical side of the guide slot, and to define a second vertical side of said processing channel, opposite said first vertical side of the processing channel, the integral portion of the rack which defines said second vertical side of the processing channel including said plurality of liquid distribution openings to the processing channel.

2. The improvement as recited in claim 1, wherein said integral portions of the tank which define said first vertical side of the guide slot and said first vertical side of the processing channel are essentially respective portions of a common wall of said tank, and said integral portions of the rack which define said second vertical side of the guide slot and said second vertical side of the processing channel are essentially respective portions of a common wall of said rack, the common wall of said tank and the common wall of said rack extending in substantially parallel relation to locate the guide slot and the processing channel in a similar relation.

3. The improvement as recited in claim 1, wherein said integral portion of the rack which defines said second vertical side of the processing channel is a wall portion of said rack, and said plurality of liquid distribution openings to the processing channel are arranged on said wall portion in respective series of alternating numbers of openings.

4. The improvement as recited in claim 1, further comprising:

said rack includes enclosure means for forming a substantially enclosed vertical liquid receiving cavity, the enclosure means constituting in part said integral portion of the rack which defines said second vertical side of the processing channel to permit a processing liquid in said cavity to flow through said plurality of liquid distribution openings to the processing channel.

5. The improvement as recited in claim 4, further comprising:

said rack includes a liquid introduction conduit to said liquid receiving cavity; and said tank includes a liquid drain conduit from said processing channel.

* * * * *